United States Patent [19]

Steinhilber

[11] 4,248,415

[45] Feb. 3, 1981

[54] APPARATUS FOR FEEDING SHEETS OF PAPER FROM A MAGAZINE TO A PRINTING OFFICE MACHINE

[76] Inventor: Helmut Steinhilber, Königstr. 47, D-7210 Rottweil, Fed. Rep. of Germany

[21] Appl. No.: 29,146

[22] Filed: Apr. 11, 1979

[30] Foreign Application Priority Data

Apr. 15, 1978 [DE] Fed. Rep. of Germany ..... 2816442

[51] Int. Cl.[1] ..... B65H 5/26

[52] U.S. Cl. ..... 271/9; 271/10; 271/116; 271/242

[58] Field of Search ..... 271/8, 10, 109, 110, 271/113, 116, 242, 9; 400/625, 629

[56] References Cited

U.S. PATENT DOCUMENTS

| | | | |
|---|---|---|---|
| 2,366,206 | 1/1945 | Metzner | 400/625 |
| 3,776,545 | 12/1973 | White | 271/116 X |
| 4,089,402 | 5/1978 | Hyland | 400/625 |

*Primary Examiner*—Richard A. Schacher
*Attorney, Agent, or Firm*—Blair, Brown & Kreten

[57] ABSTRACT

An apparatus for feeding single sheets of paper to a printing office machine, for example a typewriter, bookkeeping machine, etc. The paper is held in a stack within one or more magazines and the top sheet of the stack is engaged by a separating roller which is driven by a gear belt from the printing platen or another rotating part of the associated office machine. In order to insure the exact positioning at the entrance of the printing platen slot of the sheets of paper delivered by the separating roller, the apparatus provides that when the separating roller transports a sheet of paper forward to the printing platen, the printing platen is rotating backward at that time, preventing entry of the new sheet but insuring its position while the continued motion of the separating roller causes the new sheet to bulge. Thereafter, the direction of motion of the printing platen is reversed, causing the reliable advance of the paper into the office machine. During this time, an overrunning clutch prevents reverse motion of the separating roller. In order to provide for the limited reversal of motion of the printing platen during the printing process, a lost motion mechanism in the drive of the separating roller permits limited paper reversal. A number of embodiments of the drive mechanism for the separating roller is presented.

15 Claims, 11 Drawing Figures

FIG. 3
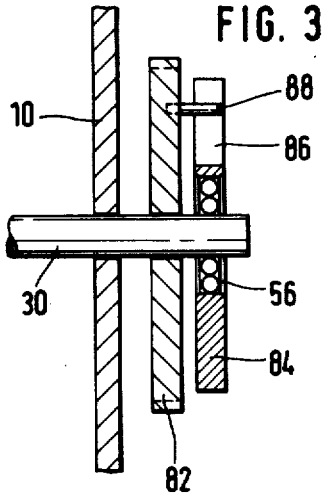
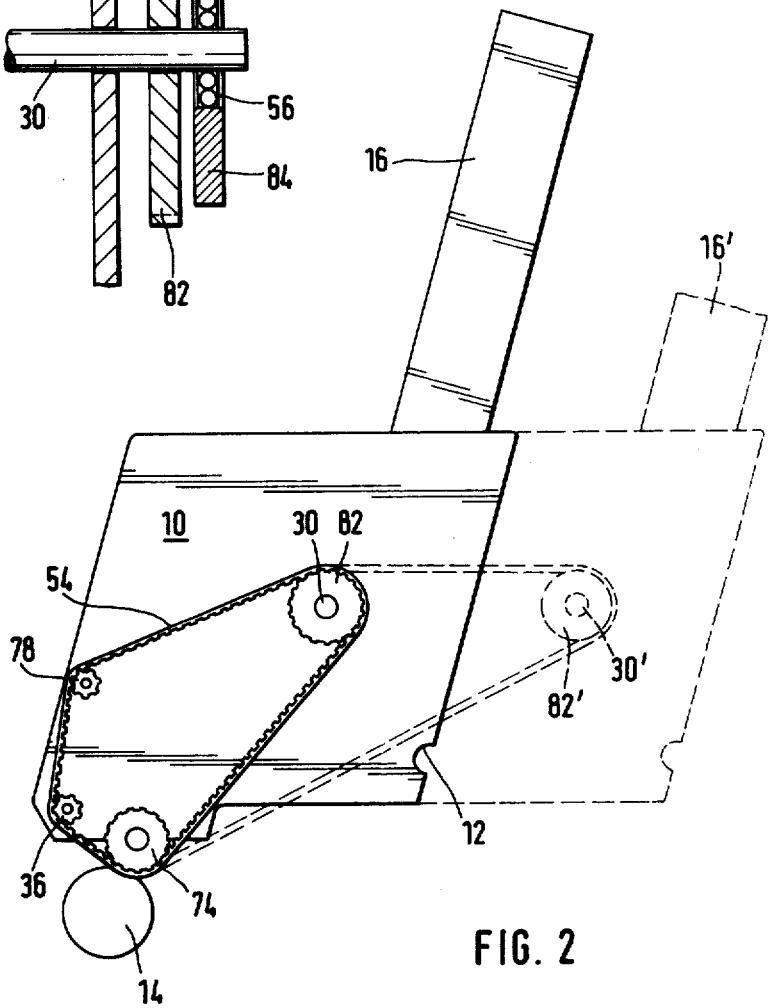
FIG. 2

APPARATUS FOR FEEDING SHEETS OF PAPER FROM A MAGAZINE TO A PRINTING OFFICE MACHINE

FIELD OF THE INVENTION

The invention relates to paper feed mechanisms for office machinery, especially printing office machines, in which a ream of paper is stored in a suitable magazine or cassette and individual sheets of paper are fed sequentially to the printing platen of an office machine associated with the paper feed mechanism. A top sheet separating roller makes continuous contact with the top sheet in the paper stack and the entire paper feed mechanism is driven by the printing platen of the associated office machine. The paper feed mechanism is removable from the associated office machine.

BACKGROUND OF THE INVENTION AND STATE-OF-THE-ART

An apparatus of the aforementioned type is described in the German Offenlegungsschrift No. 2632463. In this known apparatus, the paper feed mechanism is powered by the printing platen of the office machine via gear belts which drive the top sheet separating roller that pulls individual sheets from the stack of paper in the paper magazine. The apparatus described there also includes paper transport rollers which are also driven by the gear belts and serve to deliver imprinted paper from the printing platen to a paper holder. The apparatus described in the aforementioned publication thus does not require its own power source and driving motors for the purpose of top sheet transport, paper feed and paper removal. Furthermore, all the transport operations are controlled by the associated printing office machine so that the paper feed mechanism requires no independent control systems and it is not necessary to synchronize the operation of the office machine and the paper feed mechanism.

In the known apparatus, the direction of rotation of the top sheet separating rollers results in the same paper advance direction as that provided by the printing platen of the office machine but the separating roller turns with a somewhat lower tangential speed. As soon as the top sheet of paper has been pulled off by the separating roller from the stack of paper and has reached the entrance gap of the printing platen, the latter takes over the further transport at increased speed. Accordingly, the onset of the transport of the paper by the printing platen depends on a number of factors among which is the frictional effect of the separating roller and the transporting speed and duration from the stack of paper to the platen. However, the speed or duration of the paper transport is subject to fluctuations because when the paper is transported to the printing platen, it must pass over a braking roller which turns in the direction opposite to the direction of motion of the sheet. Accordingly, the moment at which the printing platen can begin the further transport of the sheet is not well defined and this fact results in fluctuations and imprecision of the line positioning of the sheet for the subsequent imprinting which is under automatic control.

The German Pat. No. 207093 discloses an apparatus for feeding single sheets of paper from a stack of paper to the printing platen of an office machine wherein the separating roller is powered by the printing platen via a power transmitting gear or wheel. The intermediate wheel is a friction wheel that lies on the printing platen subject to the weight of the paper feed mechanism. In the apparatus described here, the separating roller also rotates in the same direction as the printing platen, causing individual sheets of paper to be grasped immediately by the printing platen. The initial position of the paper for the purpose of beginning the transport by the printing platen is thus also poorly defined resulting in the aforementioned problem. U.S. Pat. No. 2,887,208 describes a paper feed mechanism in which the top sheet separating function is performed by a circulating belt which is driven by the printing platen via a gear belt. In this apparatus the paper transport is initiated by the separating belt when the printing platen rotates in the direction of forward transport. Accordingly, the above cited disadvantages of the imprecision of the initial position of the sheet when it enters the region of the printing platen are also present. This apparatus includes a manual clutch which prevents the corotation of the top sheet separating belt if the printing platen must be turned backward during the imprinting of the paper.

OBJECT AND SUMMARY OF THE INVENTION

It is a principal object of the present invention to provide a paper feed mechanism of the general type described above which is so constructed that each sheet of paper reaches the printing platen in a precisely defined initial position, permitting the precise alignment of the paper to be imprinted by the platen so as to correct the position of each imprinted line.

This and other objects are attained according to the invention by providing that the gear train which transmits the rotation of the printing platen to the top sheet separating roller permits these two rollers to rotate with relatively opposite directions of rotation causing opposite directions of motion for the tangentially transported sheet of paper.

When the printing platen is rotated backwardly, i.e., in the direction opposite to that which would introduce a sheet of paper into the office machine, it causes the rotation of the top sheet separating roller in such a direction as to separate the top sheet and move it toward the printing platen. When this sheet arrives at the entrance slot to the printing platen, it cannot be received and cannot enter because the printing platen is rotating in a direction opposing entry. Accordingly, the sheet remains positioned immediately ahead of the printing platen and tends to bulge there due to the continued advancing forces of the separating roller. However, its position and in particular the position of its front edge is precisely fixed, i.e., it is known to be in the same position of the entrance slot of the printing platen for each and every case. Subsequently the rotation of the printing platen is reversed and it is turned in the normal paper advancing direction, therefore causing the advance of the waiting sheet of paper into the office machine in a precisely defined relative position permitting the exact positioning of the printed lines on the sheet of paper.

While the printing platen is rotated in the paper advancing direction, the paper separating roller is stationary due to the presence of an overrunning clutch which prevents corotation in this direction of motion of the platen and thereby prevents the separating roller from affecting the transport of the sheet of paper by the printing platen.

The various transport functions performed by the paper feed mechanism according to the invention, i.e., the separation of the top sheet, the transport of the sheet into the platen and the expulsion of the imprinted sheet can be performed and controlled automatically in relatively simple fashion. The top sheet removal and transfer requires only that the printing plate be reliably reversed by a particular amount which is so determined as to cause the bulged arrival of the sheet at the entrance slot to the printing platen. At any time thereafter, the rotation of the printing platen can be reversed, causing the insertion of the paper into the printing machine in accordance with the line positioning required. After the paper has been imprinted in the desired manner, the platen together with the transport rollers cause the expulsion of the paper into the paper holder. At any time thereafter, the printing platen may be reversed in direction, thereby engaging the free-wheeling clutch of the separating roller and causing the pickoff and separation of the next top sheet of paper.

It may happen during a normal imprinting process that it is required to reverse the platen by a few lines to make a correction or the like which would normally cause an attendant forward rotation of the separating roller. If it happens at a time when the separating roller is still in contact with the sheet being imprinted, it causes no difficulty whatever. However if the reversal of the platen happens at a time when the sheet of paper has passed from under the separating roller which therefore is in contact with a new sheet, the premature pickoff and transport of the subsequent sheet would tend to disturb the orderly progress of sheets of paper. In order to prevent the unintended pickoff of the second sheet of paper, the gear train has a lost motion element which permits a limited amount of reverse motion before engaging the paper separating roller drive.

Thus, if the printing platen is rotated backwardly by a few lines, the gear train is engaged only after the lost motion has been fully traversed and as long as the number of lines by which the platen is reversed is smaller than the extent of the lost motion, a limited reversal of the platen will not cause any driving of the separating roller with an attendant displacement of the next sheet of paper. In the simplest construction, the lost motion element may consist of a disc in which a sector is opened and is engaged by the pin of a coaxial gear, the angular extent of the sector being chosen to be larger than the angular extent of the pin or sector engaging protrusion.

In another variant of the invention, it is possible to use two or more paper magazines or cassettes in the apparatus and to provide for selective admission of sheets from any of these magazines. Each of the magazines will then be associated with an individual separating roller which is driven in the manner already described, i.e., it is engaged by reversing the rotation of the platen with respect to the direction of normal transport. The apparatus would be equipped with a control system which assigns the motion of the separating roller to only the magazine from which paper is demanded.

In the simplest case, the gear train may be embodied as a gear belt which transmits the rotary motion of the main power drive wheel to the individual separating rollers of the one or more paper magazines.

Other advantages and characteristics of the invention will derive from the ensuing detailed description of a number of preferred embodiments to be read with reference to the drawing.

BRIEF DESCRIPTION OF THE DRAWING

FIG. 2 is a partial side view of the apparatus of the invention;

FIG. 3 is an axial section through a lost motion mechanism in a first embodiment;

DESCRIPTION OF THE PREFERRED EMBODIMENTS

The apparatus according to the invention includes a housing consisting principally of two side walls 10 rigidly connected with one another by transverse rails or bars with rearward recesses 12 which serve for locating and placing the apparatus in cooperating elements of an associated printing office machine, for example a typewriter or bookkeeping machine or the like, not shown.

The only element of the printing office machine which is illustrated is a printing platen 14 on which the apparatus according to the invention rests with frictional contact wheels 74. Due to the dead weight of the apparatus, the frictional wheels 74 which are located in the side walls 10 make good frictional contact with the surface of the printing platen 14.

Figure 1:
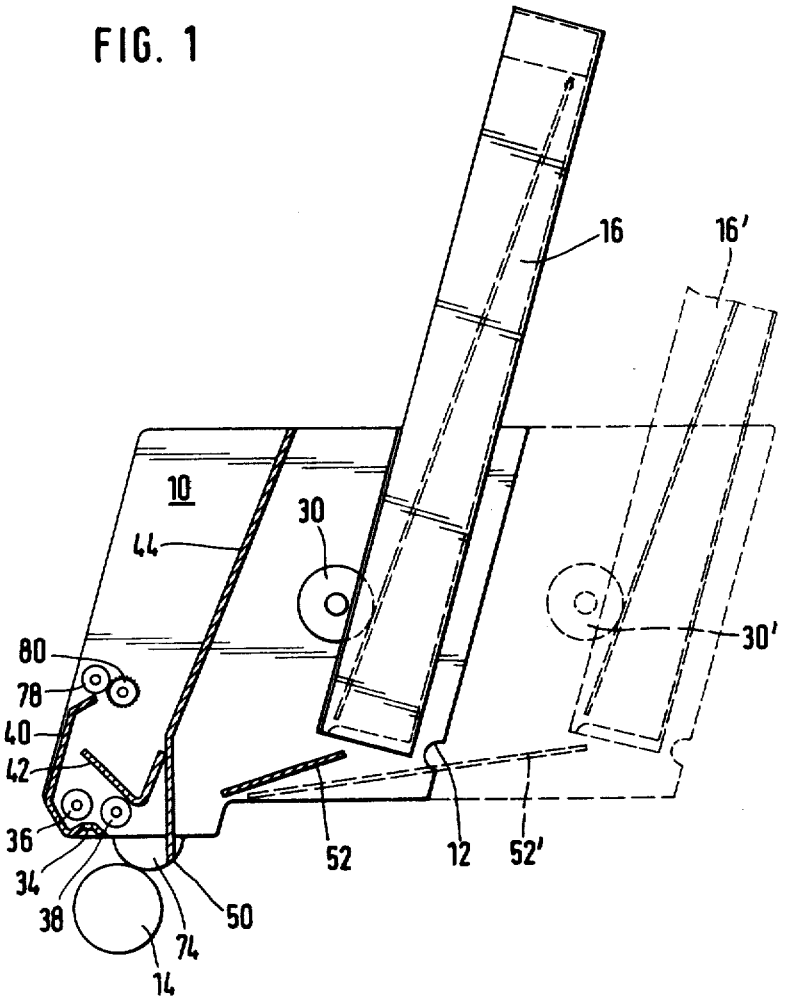
FIG. 1 is a side elevational sectional representation of the apparatus for feeding paper according to the invention.

In order to make the transfer of motion even more reliable, a toothed ring may be mounted on the printing platen and the friction wheel 74 may be replaced by gears. Seated within the side walls 10 in a manner not further described is a paper storage cassette 16 which contains a ream of paper to be imprinted. The topmost sheet of the paper stack is in constant contact with a separating roller 30 of which only the end of the shaft extending through the side walls 10 is illustrated in FIGS. 1 and 2.

The cassette includes a corner top sheet separating tab mechanism which is not shown but which serves to snap the top sheet of paper from the stack of paper when the separating roller drives it downwardly. A guide channel 50, 52 serves to feed the sheet of paper to the entrance slot for the printing platen 14.

After being imprinted, the printing platen 14 transports the paper through a funnel 34 upwardly where it is grasped by two transport rollers 36, 38 of which the roller 36 is driven while the roller 38 is a pressure roller capable of free rotation.

The rollers 36, 38 move the imprinted sheet upwardly and fling it into a paper holder formed by angled foil 42 and supported in the rear by a rear wall 44.

The normal rotational speed of the printing platen 14 does not suffice to lift and throw the paper into the paper holding device 42 after imprinting. In order to perform this transport, there is disposed a second pair of rollers 78 only one roller being shown in FIG. 2. The transport roller 78 may also be powered by the gear belt 54. The paper passes from the pair of rollers 36, 38 upwardly to the transport rollers 78 which lift the imprinted paper into the paper holding device 42.

A rubber spoke wheel 80 is mounted coaxially with a pressure roller bearing against the drive roller 78 to insure that the imprinted sheet of paper departs from the gap between the rollers 78 and actually passes into the paper holder 42.

As illustrated in FIG. 2, the transport rollers 36 and 78 as well as the printing platen 14 are all rotated in the same direction of paper advance. For example, if the printing platen 14 is rotated in the clockwise sense as illustrated in the drawing, i.e., in the sense in which a sheet of paper would be pulled into the platen and eventually expelled therefrom, then the transport rollers 36 and 78 are rotated in the same direction, i.e., to tend to transport the imprinted paper upwardly, i.e., in the same direction as the printing platen 14.

However, it will be appreciated that the separating roller 30 then would tend to rotate in the counterclockwise sense, as driven by the friction wheels 74, the gear belt 54 and a gear 82. This counterclockwise rotation of the separating roller 30 which would tend to move the top sheet of paper away from the printing platen, actually is prevented by means to be described further below. However, when the printing platen rotates in the counterclockwise sense, i.e., in the direction opposite the insertion of paper, the separating roller 30 rotates clockwise.

Figure 4:
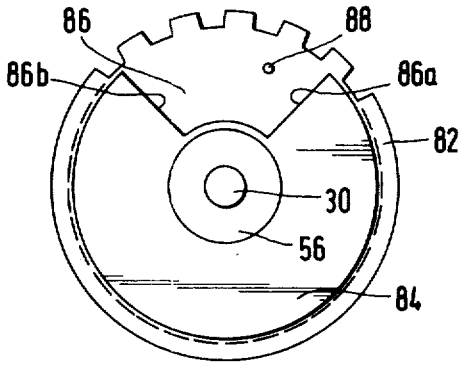
FIG. 4 is a side view of the device illustrated in FIG. 3.

The mechanism for driving the separating roller 30 by the gear belt 54 is illustrated in a first exemplary embodiment with the aid of FIGS. 3 and 4. The aforementioned gear belt 54 engages the gear 82 which is mounted freely rotatable on the shaft of the separating roller 30. A clutch disc 84 having an overrunning clutch 56 is mounted axially adjacent to the gear 82 on the shaft of the separating roller 30. The overrunning clutch mechanism in the clutch disc 84 is so constructed as to engage when the disc 84 rotates in the clockwise sense with respect to the shaft 30 as seen in FIGS. 1 and 2 and thereby corotating the shaft 30, whereas it disengages when the clutch disc 84 rotates in the counterclockwise sense with respect to the shaft 30, in which case it does not rotate the shaft 30. A sector 86 of given angular extent is formed in the clutch disc 84 and receives a pin 88 that extends eccentrically from the face of the gear 82.

The mechanism illustrated in FIGS. 3 and 4 operates in the following manner.

In order to initiate the insertion of a single sheet of paper from the paper magazine to the platen, the printing platen 14 is rotated backwardly by a control mechanism in the office machine, i.e., it is rotated in the direction opposite to the direction which would advance paper and that is the counterclockwise direction in the drawing of FIGS. 1 and 2. During this motion, the gear 82 is rotated in the clockwise sense, causing the pin 88 to make contact with the edge **86*a* of the sector 86 in the clutch disc 84. The clutch disc 84 is thus rotated in a clockwise sense, its overrunning clutch 56 engages and causes the shaft of the separating roller to rotate in the clockwise sense. In this manner, the top sheet of the stack of paper in the paper magazine or cassette is transported in the direction of the paper platen 14. However, during this step, the paper platen 14 rotates in the direction opposite to that which would cause paper to advance to the platen so that the sheet of paper cannot enter the entrance gap of the platen 14 and becomes bulged. Now the platen is reversed, pulls the paper in and the gear 82 turns counterclockwise, while the pin 88 moves from the edge 86*a* toward the edge 86*b*. At that point when the pin has traversed the angular extent of the sector 86, during which time the paper is being advanced, and when the pin 88 makes contact with the edge 86*b*, the clutch disc 84 is rotated in the counterclockwise sense and its overrunning clutch mechanism 56 prevents corotation of the separating roller 30**.

If it is necessary during the imprinting of the paper to turn the printing platen backward, so as to return to previously imprinted lines on the paper, then the gear 82 is rotated clockwise, causing the pin 88 to migrate from the edge **86*b* back to the edge 86*a*. During this migration, whose length is determined by the angular width of the sector 86, the clutch disc 84 does not turn so that the separating roller 30 is also not rotated. As long as the reverse rotation of the printing platen is smaller than the angular width of the sector 86, a reversal of the paper by a given number of lines does not cause any rotary motion of the separating roller 30**.

If the printing platen 14 is now reversed again and begins to advance the paper in the normal direction, the pin 88 migrates back to the edge **86*b* of the sector. When the printing process is finished and the paper is to be expelled by the pairs of rollers 36, 38 and 78, 80, respectively, the printing platen 14 is advanced in the clockwise sense by a relatively large amount so as to insure that the pin 88 makes contact with the edge 86*b*. This insures also that the entire mechanism is in its initial position for transporting a subsequent sheet of paper toward the printing platen 14. This new insertion begins with the step of reversing the printing platen by an amount at least equal to the angular width of the sector 86, i.e., until the pin 88 makes contact with the edge 86*a*** whereafter it is continued to rotate to insure that the separated sheet which was fed to the printing platen assumes the aforementioned bulged shape prior to insertion in the entrance gap of the platen.

Figure 5:
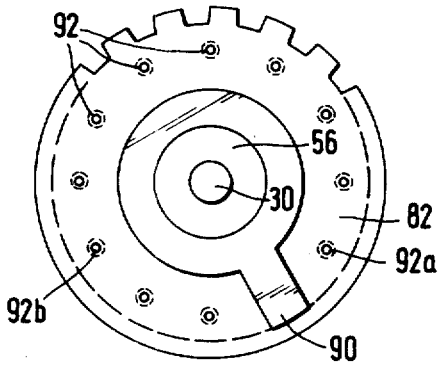
FIG. 5 is an end view of a second embodiment of the lost motion device of the invention.

A variant of the embodiment illustrated in FIGS. 3 and 4 is shown in FIG. 5. In the main, this variant is equivalent to that of FIGS. 3 and 4. However, in this case the clutch disc 84 is replaced by a radial cam 90 of relatively small angular extent. The axial face of the gear 82 has a number of holes which are located on the same radial circle in angular spacing. Two of these holes, for example **92*a* and 92*b***, contain actuating pins.

The overall rotary drive of the mechanism is the same as that previously described with respect to FIGS. 3 and 4. However, the separating roller 30 in the example of FIG. 5 is driven whenever the pin in the hole **92*a* makes contact with the cam 90 during the clockwise rotation of the gear 82. When the sense of rotation of the printing platen 14 is reversed for the purpose of pulling the paper into the printing platen 14, a lost motion occurs until the pin in the hole 92*b* makes contact with the cam 90. At that point the cam 90 is carried along, and the overrunning clutch 56 prevents corotation of the separating roller 30**.

The advantage of the embodiment of FIG. 5 is that the timing of the lost motion mechanism can be changed and adjusted simply by placing the actuating pins in different ones of the holes 92. In this way the mechanism can be adapted to a particular application.

Figure 6:
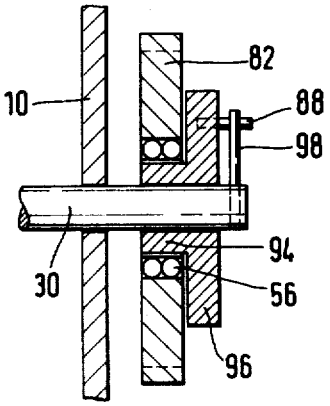
FIG. 6 is an axial section through a third embodiment of the lost motion device according to the invention.

A still further variant of the invention is illustrated in FIG. 6. In this case, the gear 82 is provided with an overrunning clutch 56 and is mounted on the axially extending hub of a disc 96 which rotates freely on the shaft 30. The face of the disc 96 has holes which compare to the holes or bores 92 in the example of FIG. 5. Depending on the amount of lost motion desired, pins 88 are inserted in two of these holes. The function of the clutch disc 84 of the previous example is taken here by a pin 98 extending radially from the shaft 30.

It is necessary for the correct functioning of the embodiment of FIG. 6 that the relative rotary friction between the disc 96 and the shaft 30 is lower than the internal friction of the overrunning clutch 56.

The manner of operation of the embodiment of FIG. 6 is as follows. When the gear 82 is rotated in the clockwise sense, the overrunning clutch 56 engages and corotates the disc 96, causing one of the pins 88 to make contact with the radial pin 98 and thus corotating the separating roller 30. When the printing platen 14 rotates in the clockwise sense for receiving a sheet of paper the gear 82 rotates counterclockwise. Because the running friction of the overrunning clutch 56 is greater than the friction of the disc 96, the latter is carried along by the gear 82 until the lost motion is overcome and the other pin 88 makes contact with the radial pin 98. The resistance to rotation offered by the pin 98 is substantially higher due to the fact that the separating roller 30 engages the paper stack so that any further rotation of the gear 82 disengages the overrunning clutch 56 and prevents further rotation of the disc 96. When the printing platen 14 is reversed, i.e., when the gear 82 rotates clockwise, the overrunning clutch 56 reengages and the first mentioned pin 88 approaches the radial pin 98.

A fourth embodiment is illustrated in FIGS. 7–11 and permits the separation and transport of individual sheets of paper to the printing platen of the associated office machine even when two or more paper magazines are being used. Such an apparatus is indicated schematically in FIGS. 1 and 2 wherein the second paper magazine 16' is shown in dashed lines.

The second magazine 16' is located directly behind and parallel to the first magazine 16. It is associated with a second separating roller 30' which is driven by means of a gear 82' and the gear belt 54. As illustrated in FIG. 2, the gear belt 54 then runs over the friction wheel 74, the transport rollers 36 and 78 as well as both gears 82 and 82'. The manner in which the separating roller 30 is driven by the gear belt disc 82 will be described with reference to FIGS. 7–11. The manner of rotating the separating roller 30' by means of the gear 82' is substantially the same so that the discussion of the case of driving the roller 30 will also apply to the second magazine and its separating roller 30'.

Figure 11:
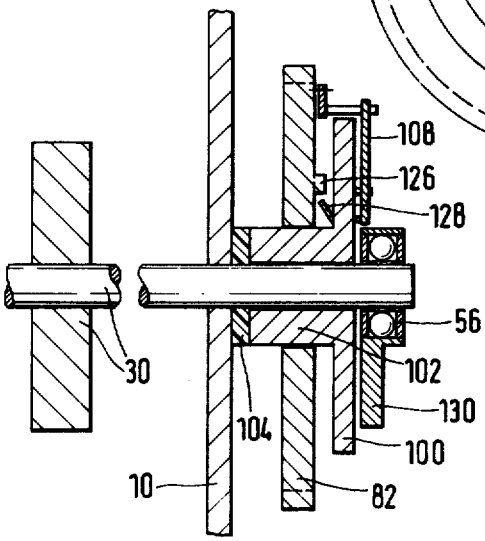
FIG. 11 is an axial section through the embodiment illustrated in FIGS. 7–10.

As best seen in the axial section of FIG. 11, the belt gear 82 rotates freely on the hub 102 of a control disc 100 which itself rotates freely on the shaft of the separating roller 30. However the rotation of the control disc 100 is impeded by a friction layer 104 on the end face of the hub 102 making contact with the side wall 10 of the paper feed mechanism. The control disc 100 is a circular disc whose diameter is somewhat smaller than that of the belt gear 82. The circumference of the control disc 100 has a radial depression 106.

Figure 7:
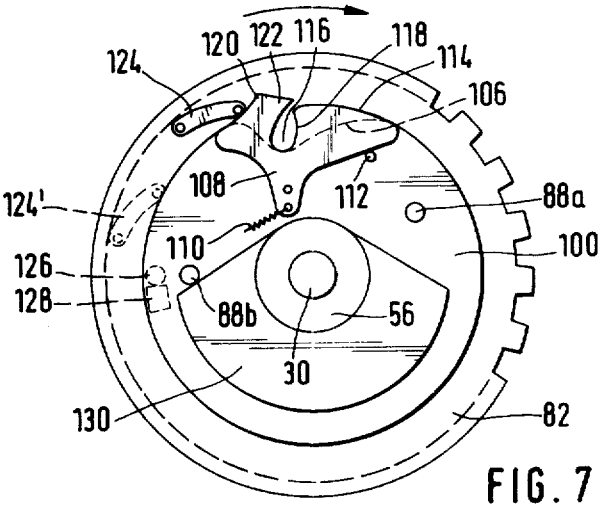
FIGS. 7–10 are a sequence of illustrations showing various operational states of a fourth embodiment of the lost motion transport according to the invention.

A ratchet lever 108 is pivotably mounted on the control disc 100 within the depression 106 and in its normal position it is urged by a spring 110 to make contact with a stop pin 112 in the control disc 100, as seen for example in FIG. 7. The outer contour 114 of the ratchet lever 108 coincides in the rest position with the circular circumference of the control disc 100 so that the ratchet lever 106 may be said to compensate for the depression 106 in the disc. The contour 114 of the ratchet lever 108 has a ratcheting recess 116 with a support edge at the right side as seen in the drawing, i.e., at the side which points in the driving direction of the separating roller 30. Ahead of the recess 116 as seen in this direction of rotation, the ratchet lever 108 has a step 120 which extends beyond the periphery of the control disc 100 in the normal initial position as seen, for example, in FIG. 7. The step 120 continues into a projection 122 which extends beyond the circumference of the ratchet recess 116.

Pivoting on the belt gear 82 is a pawl 124 which makes contact at the periphery of the control disc 100 and the ratchet lever 108 under the force of a spring, not shown.

Located between the belt gear 82 and the control disc 100 is a protrusion 126 mounted on the belt gear 82 as well as a leaf spring stop 128 mounted on the control disc 100 with its rearward end in the sense of the driving direction of the separating roller 30, i.e., the spring stop 128 rises from the end face of the control disc 100 in the clockwise sense of the drawing.

Axially adjacent to the control disc 100 is a clutch disc 130 having an overrunning clutch 56 and it is mounted on the shaft 30 of the separating roller. The clutch disc 130 has the shape of a circular sector. Disposed within the end face of the control disc 100 are two pins **88*a* and 88*b* which make contact with the clutch disc 130. The pins 88*a* and 88*b* may be placed in selected ones of several holes or bores 92 of the control disc 100** so as to change their relative angular separation.

The function and manner of operation of the embodiment of FIGS. 7–11 is as follows.

The separating of the top sheet of the stack and its transport toward the printing platen will now be described. This initial phase begins with the position shown in FIG. 7. In this initial position, the protrusion 126 makes contact with the leaf spring stop 128 and the pin **88*b* is in contact with the clutch disc 130. The ratchet lever 108 is in its rest position, i.e., the force of the spring 110 causes it to make contact with the stop 112. The pawl 124 is located ahead of the step 120 of the ratchet lever 108** in the clockwise sense.

Figure 8:
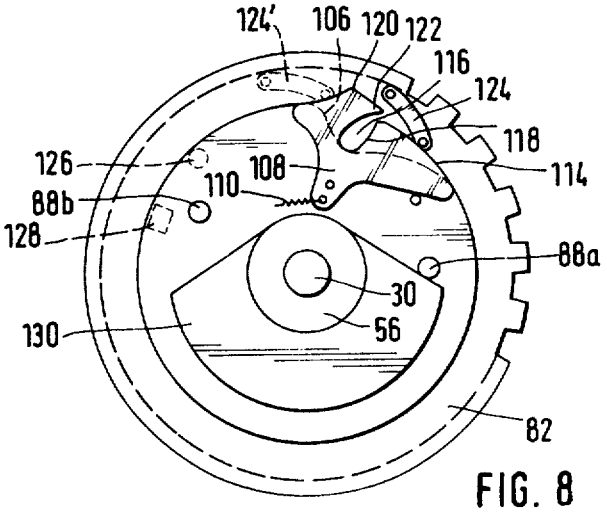

When the office machine now rotates the printing platen 14 backwardly, i.e., in the direction opposite to the normal direction of paper advance, the belt gear 82 is rotated clockwise as indicated by the arrow in FIG. 7. During this rotation of the belt gear, the pawl 124 making contact with the step 120 rotates the control disc 100 clockwise until the pin **88*a* makes contact with the clutch disc 130. The clutch disc 130 is coupled through the overrunning clutch 56 which engages in the clockwise sense with the separating roller 30 lying against the paper stack and thus offers substantial resistance. This resistance prevents a further rotation of the control disc 100 as soon as the pin 88*a* makes contact with the clutch disc 130. During further rotation of the belt gear 82, the pawl 124 thus passes over the step 120 and the projection 122 guides it beyond the ratchet recess 116 into the position illustrated in FIG. 8. The rotation of the belt gear 82 required to bring the mechanism from the initial position shown in FIG. 7 to the position shown in FIG. 8 is defined by the angular position of the pins 88*a* and 88*b* as well as the angular extent of the clutch disc 130 and the angular measurement of the ratchet lever so that the change of position may be brought about by a precise counterclockwise rotation of the printing platen 14** under the control of the office machine.

Figure 9:
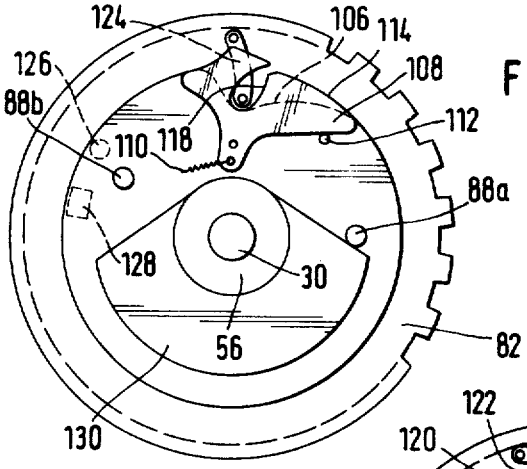

After this well defined rotation of counterclockwise rotation of the printing platen 14, the platen 14 is now rotated clockwise by the equivalent of a few lines of print. The rotation of the platen 14 in the normal paper advancing direction causes a counterclockwise rotation of the belt gear 82. During this motion, the pawl 124 returns along the periphery of the ratchet lever 108 and snaps into the ratchet recess 116 as shown in FIG. 9. The frictional layer 104 prevents a corotation of the control disc 100 during this limited reverse motion.

The disposition illustrated in FIG. 9 is the position from which the paper separation and transport takes place. The printing platen 14 is again rotated in the direction opposite to the normal paper advance direction, i.e., counterclockwise, thereby rotating the belt gear 82 clockwise. The pawl 124 is supported by the edge 118 of the recess 116, causing the belt gear 82 to corotate the control disc 100. The pin 88*a* on the disc 100 corotates the clutch disc 130 whose engaged overrunning clutch 56 drives the separating roller 30.

In this way, the top sheet of the ream of paper in the magazine is separated and is advanced by an amount controlled by the associated office machine until it is in place at the entrance of the platen funnel of the machine and has been suitably bulged.

The actual insertion of the paper into the office machine now begins with a controlled clockwise rotation of the printing platen 14. This motion drives the belt gear 82 counterclockwise as shown by the arrow in FIG. 10. During the counterclockwise rotation of the belt gear 82, the pawl 124 pushes the ratchet lever 108 from its rest position and against the force of the spring 110 into the position drawn in FIG. 10 because the friction layer 104 prevents the control disc 100 from corotation. In the pivoted position, the projection 122 is depressed radially beneath the periphery of the recess 106 so that any further rotation of the belt gear 82 causes the pawl 124 to follow the periphery of the recess 106 outwardly and causes it to be lifted from the ratchet recess 116.

Figure 10:
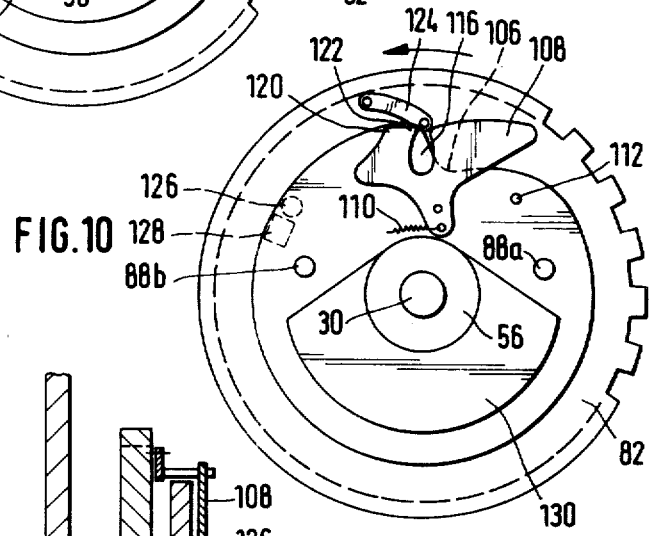

As soon as the pawl 124 has been lifted over the projection 122, the ratchet lever 108 is snapped back into its rest position by the spring 110 and the pawl 124 is again located ahead of the step 120 as it was in FIG. 7. During this counterclockwise rotation of the belt gear 82, the projection 126 again makes contact with the spring stop 128 as shown in FIG. 10. Any further counterclockwise rotation of the belt gear 82 during the paper advance through the printing platen and during the imprinting of the paper takes place while the projection 126 makes contact with the elastic stop 128, so that during such motions, the control disc 100 is corotated by the belt gear 82. In this way, the pin 88*b* makes contact with the clutch disc 130 so that the entire mechanism reassumes the initial disposition illustrated in FIG. 7.

In this position, the paper to be imprinted is advanced by the printing platen 14. If the paper needs to be reversed by the equivalent of a few printed lines, the belt gear 82 is rotated clockwise. However, this limited rotation does not affect the separating roller until the pin 88*a* makes contact with the clutch disc 130. The angular separation between the pin 88*a* and the clutch disc 130 in the initial position shown in FIG. 7 thus represents a lost motion the amount of which permits the platen 14 to be reversed during the printing without rotating the separating roller 30.

When the printing has been completed, the paper must be ejected by the printing platen 14 requiring a substantial amount of clockwise rotation which insures in all cases that the entire mechanism returns to the well defined initial position illustrated in FIG. 7. This position insures in each case a precise control of the paper advance by the control keyboard of the office machine.

If the apparatus is equipped with a second paper magazine 16' and a second separating roller 30' driven by a second gear 82', the drive function is the same as already explained with respect to the mechanism illustrated in FIGS. 7–11. The single difference is that the mounting point of the pawl 124' on the second belt gear 82' would be displaced by a certain angle with respect to the similar mounting point of the pawl 124 on the first belt gear 82. This difference is illustrated in FIGS. 7 and 8 by dashed lines for the position of the pawl 124'.

The selection and control of the paper magazine from which it is desired to feed paper takes place as follows.

If it is desired to transport a sheet of paper from the first paper magazine 16, the office machine drives the printing platen 14 and the belt gear 82 in the above-described manner. As already discussed, the printing platen 14 is rotated counterclockwise and the belt gear 82 clockwise until the pawl 124 snaps beyond the ratchet recess 116 into the position illustrated in FIG. 8. Thereafter, a limited clockwise rotation of the platen 14 causes the pawl 124 to snap into the ratchet recess 116.

During this time, the belt 54 drives the gear 82' in synchronism with the first belt gear 82. Due to the angular displacement of the pawl 124' with respect to the pawl 124 the pawl 124' is able to assume only the position shown in dashed lines in FIG. 8 so that when the limited clockwise rotation of the printing platen 14 occurs the pawl 124' is unable to snap into the ratchet recess of the associated ratchet lever. During the subsequent counterclockwise rotation of the printing platen 14, only the first separating roller 30 can be driven because only its pawl 124 is seated in the ratchet recess 116. The belt gear 82' associated with the second separating roller 30' is unable to corotate its control disc because the pawl 124' is not seated and jumps over the ratchet recess during the clockwise rotation of the belt gear 82'.

However, if it is intended to select a sheet of paper from the second paper magazine 16', the printing platen 14 is rotated counterclockwise beginning with the position of FIG. 7 and thus causes a clockwise rotation of both melt gears 82 and 82'. The extent of this rotation is so controlled by the office machine as to extend beyond the position shown in FIG. 8, i.e., until the pawl 124' has also passed the associated ratchet recess. Thereafter, the office machine controls a short limited clockwise rotation of the printing platen causing a counterclockwise rotation of the belt gears 82 and 82'. This motion causes the seating of the pawl 124' in its ratchet recess whereas the pawl 124 of the first belt gear 82 is not rotated back far enough to snap into its recess 116.

Accordingly, when the printing platen 14 is rotated counterclockwise and the belt gears 82 and 82' rotate clockwise, only the locking pawl 124' is seated, and only the control disc of the second separating roller 30' can be corotated by its belt gear 82'. The pawl 124 on the other hand glides along the periphery of the control disc 100 and passes over its ratchet recess 116 during this further rotation.

Due to the elastic construction of the stop 128 in the leaf spring, the projection 126 may pass over the stop 128 in the clockwise sense without affecting the rotary motion of these parts.

The embodiment of the separating roller controller as illustrated in FIGS. 7–11 thus makes possible a very simple control process for driving the printing platen 14 so as to provide separating and transport of individual sheets of paper to the printing platen of the machine from one or more different paper reservoirs.

If more than two paper reservoirs are used, the respective locking pawls 124 for the various magazines must be displaced with respect to one another by a particular angle in order to provide the operation described above for the locking pawl 124'.

No other changes are required to perform the selective transport of sheets of paper from a plurality of magazines.

The foregoing description of the invention relates to merely preferred but non-limiting embodiments thereof. Other embodiments and variants, and the use of the features of one embodiment in any other are all possible within the spirit and scope of the invention.

I claim:

1. An apparatus for feeding single sheets of paper from a stack of paper stored in a paper magazine to the printing platen of a printing office machine, said apparatus including a rotating top-sheet separating roller disposed to make continuous operating contact with said stack of paper, and said apparatus including means for operative association with said office machine and including transmission means for drivably coupling said printing platen to said separating roller, said transmission means including an overrunning clutch, said transmission means being adapted to rotate said separating roller in a paper feed direction driving the rotation of said printing platen in a direction opposite to that for introducing paper into said machine to position the top sheet from said paper stack in a precisely defined initial position, said overrunning clutch being arranged to interrupt the rotation of said separating roller during the rotation of said printing platen in the opposite paper imprinting direction.

2. An apparatus according to claim 1, wherein said transmission means includes a lost motion mechanism for permitting a limited amount of rotation of said printing platen in said opposite direction prior to the rotation of said separating roller in said paper feed direction.

3. An apparatus according to claim 2, wherein said transmission means includes a forcibly driven gear having coupler means for engaging an open sector of a coaxial clutch disc, the angular extent of said open sector being greater than the angular extent of said coupler means.

4. An apparatus according to claim 3, wherein said forcibly driven gear is freely rotatable on the shaft of said separating roller and wherein said clutch disc is coupled to the shaft of said separating roller via said overrunning clutch.

5. An apparatus according to claim 4, wherein said coupler means for engaging said sector is a pin disposed eccentrically on said forcibly driven gear and wherein said clutch disc is mounted on the shaft of said separating roller by means of said overrunning clutch and includes an open sector of predetermined angular width which is engaged by said coupler means.

6. An apparatus according to claim 4, wherein said forcibly driven gear includes a plurality of angularly displaced bores located on the same circle, said bores being capable of receiving pins which serve as said coupler means for engaging said clutch disc and wherein said clutch disc is a radial cam mounted on said shaft of said separating roller by means of said overrunning clutch.

7. An apparatus according to claim 3, further comprising a freely rotatable disc mounted on the shaft of said separating roller, and having a hub on which is disposed said forcibly driven gear by means of said overrunning clutch and wherein the friction between said disc and said shaft is less than the free running friction of said gear on said hub, and wherein said disc has a plurality of radially displaced bores on the same circle for receiving pins serving as said coupler means for engaging said clutch disc and wherein said clutch disc is constituted by a radially extending pin disposed in the shaft of said separating roller.

8. An apparatus according to claim 2, further comprising at least a second paper magazine associated with a second separating roller which makes continuous frictional operational contact with said stack of paper, said second separating roller being driven by the same transmission as said first separating roller and in the same manner, and there being associated with each of said separating rollers a control mechanism for selecting the operation of only one of said separating rollers by said transmission means.

9. An apparatus according to claim 8, wherein said control means includes a control disc disposed to rotate freely on the shaft of said separating roller and being impeded in the rotation by friction, there being pivotably mounted on said control disc a ratchet lever and pivotably mounted on said forcibly driven gear a pawl making contact with the periphery of said control disc and said ratchet lever, said pawl being capable of rigid engagement with said ratchet lever in the drive direction of said separating roller and capable of release from said ratchet lever in the opposite direction of rotation, said forcibly driven gear having a protrusion which makes contact in said opposite direction of rotation with a stop on said control disc, said coupler means for engaging said clutch disc being disposed on said control disc, said clutch disc being mounted on the shaft of said separating roller by means of said overrunning clutch and wherein the perspective pawl respectively associated with the gears are angularly displaced.

10. An apparatus according to claim 9, wherein said ratchet lever is urged by a spring against a stop, and has a control cam surface which substantially coincides with the circular periphery of said control disc in a rest position and serves to bridge a depression on said periphery and wherein there is located in said control cam surface a ratchet recess for receiving said pawl and having a support edge in the driving direction of said separating roller, and wherein said control cam has a step extending beyond the periphery of said control disc and lying ahead of said ratchet recess in the direction of driving rotation and wherein said ratchet lever may be pivoted against the force of said spring to cause a protrusion to lie radially within said depression in the periphery of said control disc.

11. An apparatus according to claim 9, wherein said coupler means includes two pins disposed on the same radial circle and in angular relative displacement on said control disc, said pins residing in bores of said control disc in adjustable manner and wherein said clutch disc has the shape of a circular sector.

12. An apparatus according to claim 9, wherein the protrusion of said forcibly driven gear is in the radial region of said control disc and wherein said stop is a leaf spring mounted on the surface of said control disc adjacent to said gear and so attached as to increase in height in the driving direction of said separating roller.

13. An apparatus according to claim 9, wherein said control disc has a hub on which is mounted said forcibly driven gear and wherein the end face of said hub is covered with a frictional material which engages a frictional coating on the surface of the housing of said apparatus.

14. An apparatus according to claim 1, wherein said transmission means includes a gear belt mechanism with a solitary gear belt, and wherein said forcibly driven gear is a gear belt disc, and wherein said apparatus includes paper transport rollers also driven by said gear belt, for providing transport and expulsion of paper from said apparatus.

15. An apparatus according to claim 14, wherein said solitary gear belt (54) drives the gear belt discs (82, 82') of a plurality of separating rollers (30, 30'').

* * * * *